US006398532B1

(12) United States Patent
Zha et al.

(10) Patent No.: US 6,398,532 B1
(45) Date of Patent: Jun. 4, 2002

(54) SINGLE SCREW COMPRESSOR

(75) Inventors: Shiliang Zha, No. 35 Haiweichashu Road, Ronggui Town, Shunde, Guangdong (CN), 52805; Qian Zha, Guangdong (CN)

(73) Assignee: Shiliang Zha, Shunde, Guangdong (CN)

( * ) Notice: Subject to any disclaimer, the term of this patent is extended or adjusted under 35 U.S.C. 154(b) by 0 days.

(21) Appl. No.: 09/696,917

(22) Filed: Oct. 26, 2000

(30) Foreign Application Priority Data

| | | |
|---|---|---|
| Oct. 26, 1999 | (CN) | 99122110 |
| Oct. 26, 1999 | (CN) | 99248828 |
| Jun. 1, 2000 | (CN) | 00107950 |
| Jun. 1, 2000 | (CN) | 00233516 |

(51) Int. Cl.[7] ..... F03C 2/00
(52) U.S. Cl. ..... 418/195; 74/458
(58) Field of Search ..... 418/195; 74/458

(56) References Cited

U.S. PATENT DOCUMENTS

| | | | | |
|---|---|---|---|---|
| 1,338,377 A | * | 4/1920 | Kopf | 74/458 |
| 3,133,695 A | * | 5/1964 | Zimmern | 418/195 |
| 3,551,082 A | * | 12/1970 | Zimmern | 418/195 |
| 3,788,784 A | * | 1/1974 | Zimmern | 74/458 |
| 3,945,778 A | * | 3/1976 | Zimmern | 74/458 |
| RE30,400 E | * | 9/1980 | Zimmern | 418/195 |
| 4,222,691 A | * | 9/1980 | Zimmern | 409/26 |
| 4,321,022 A | * | 3/1982 | Zimmern | 418/195 |
| 4,470,777 A | * | 9/1984 | Zimmern | 418/195 |
| 4,470,781 A | * | 9/1984 | Zimmern | 418/195 |
| 4,484,872 A | * | 11/1984 | Ohtsuki | 418/195 |
| 5,087,128 A | * | 2/1992 | Zimmern et al. | 418/195 |

FOREIGN PATENT DOCUMENTS

| | | | | |
|---|---|---|---|---|
| JP | 60-017284 A | * | 1/1985 | 418/195 |

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

This invention relates to a single screw compressor comprising a body housing a spindle, a screw and two pinions for engaging the screw, wherein both said pinions and said screw have unequal-width teeth, the diameter along said screw in an outer profile is varied, and the range of the closing angle formed when one of said pinion teeth engages,, with and is in close contact with one of the grooves of said screw is from 60° to 66°. The compressor according to the present invention has advantages such as high gas discharge volume, high Energy Efficiency Ratio, smallbulk, high rigidity with the pinion stand and durability.

1 Claim, 6 Drawing Sheets

Prior Art

Prior Art

Prior Art

SINGLE SCREW COMPRESSOR

BACKGROUND OF THE INVENTION

1. Field of the Invention

The present invention relates to a compressor, and particular to a novel kind ofsingle screw compress which can save power.

2. Description of the Prior Art

The techniques of single screw compressor have been improved gradually since the 1960's, and the advantages of which, such as small vibration, low noise and high reliability, have been well acknowledged. Single screw compressors havebeen widely applied to industries performing as air compressors, processing compressors, air conditioners and thermal pumps and so on.

Both the screw and the pinion(s) of a single screw compressor may be of either cylindrical shape or plain shape in an outer profile, thus constituting four kinds of compressors of CC, CP, PC and PP types as shown in FIG. 2, in which the CP type compressor is the most popular and has been manufactured at a high volume.

FIG. 1 shows a conventional CP type single screw compressor which mainly consists of a screw 1, two pinions 2, a body 6, a spindle 3, a discharge port 4 and an inlet port 5. Generally, there are six screw threads and eleven pinion teeth. The number of screw threads varies with the compression ratio, the higher the compression ratio, the more the number of screw threads. FIG. 3 is a partially cutaway section view showing a mutual engagement of a screw of a conventional CP type single screw compressor with a pinion, in which the distance from the left generating line 8 to the rotating center of the pinion is the same as that of the right generating line 8, that is, the width of the left half pinion tooth and that of the right half pinion tooth are the same. Referring to FIG. 4, pinion tooth A has been engaged with the groove of the screw and the groove is closed completing the sucking process, while pinion tooth B is compressing the gas with a low pressure; and pinion tooth C has compressed the gas to a higher pressure to start the discharge process. Compared with other kinds, the CP type single screw compressor suffers one drawback in that the energy conservation is inferior especially when the discharge volume of the gas is small.

Theoretically, the specific energy requirement may be lowered and the discharge volume mat be increased if the diameter of the pinion of a CP type compressor is properly increased without changing any of the other parameters. The depths of the grooves of the screw may also be increased to correspond to the increase of the diameter of the pinion so that both the volume of the grooves and the discharge volume of the compressor may be increased. With these modifications, in order to keep the discharge volume constant, the diameter of the screw will have to be decreased so that the peripheral velocity of the same will be lowered, leading to a decrease of the viscous sheering loss caused by the lubricant filled between the screw and the body of the compressor. Moreover, the leakage passages will have to be correspondingly decreased and the volume efficiency of the compressor will also have to be increased, for the compressor is to conserve energy. However, the increment of the diameter of a pinion is restricted by the structure of the compressor in the conventional art. Referring to FIG. 5, the section of one groove of screw 1 engaging with pinion 2 (including pinion stand 7) cannot be beyond a half circumference, that is, the corresponding angle cannot be more than 180°. In order to ensure the rigidity of the pinion stand and the convenience of installation, the largest angle $\theta_2$ that a groove could occupy equals $(180-\theta_1)$ when angle $\theta_1$ the pinion and the pinion stand occupy in the cross section of the screw is determined. Referring to FIG. 3, $\theta_3$ is the pinion's largest work rotation angle, starting from the closing of the pinion tooth with a groove of the screw until the detachment of the pinion tooth. The relation between $\theta_2$ and $\theta_3$ is described in the following formula:

$$\theta_3=\theta_2\times Z1/Z2$$

in which, Z1 stands the number of the screw threads and Z2 stands the number of the pinion teeth. FIG. 3 shows that the diameter of the pinion is the longest when $\theta_3$ is at its maximum under the conditions of the conventional art.

It is noted that the compression and the discharge of the gas in the high pressure section are accomplished at the portion further away from the axis of the screw in FIG. 4. In that case, both the torque to the axis of the screw caused by the compressed gas and the work the screw requires for its reaction to the torque are strong. Correspondingly, both the torque to the axis of the screw caused by the compressor and the work the screw requires for its reaction upon torque are also strong. Therefore, the energy consumed in a conventional compressor is very high.

SUMMARY OF THE INVENTION

An object of the present invention is to provide a novel single screw compressor with improved energy conservation to overcome the above-mentioned drawbacks in the conventional art.

According to the present invention, a single screw compressor comprises a spindle, a body, a screw and two pinions. The respective distances from the left and the right generating lines of a pinion tooth to the axis of the screw are modified so that they are not the same. That is, the width of the left half of each of the pinion tooth does not equal to that of the right half of the pinion tooth. The modified pinion teeth are referred to as unequal-width pinion teeth to distinguish them from the equal-width pinion teeth in the conventional art. The teeth of the screw are therefore unequal-width teeth. The preferred range of the closing angle $(\theta_5+\Delta\theta)$ of the compressor according to the present invention is from 60° to 66°. According to the present invention the diameter along the screw is varied in an outer profile.

BRIEF DESCRIPTION OF THE ACCOMPANYING DRAWINGS

DETAILED DESCRIPTION OF THE INVENTION

A preferred embodiment of the present invention will now be described with reference to the accompanying drawings 6 to 13.

Figure 1:
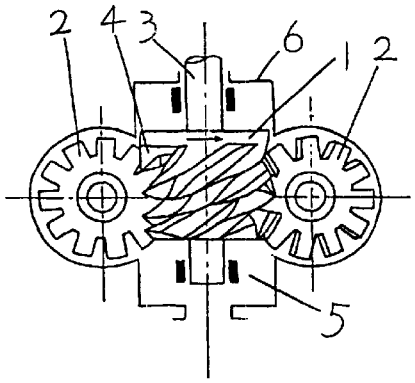
FIG. 1 Prior Art
FIG. 1 is a section view of a conventional CP type single screw compressor.
Figure 2:
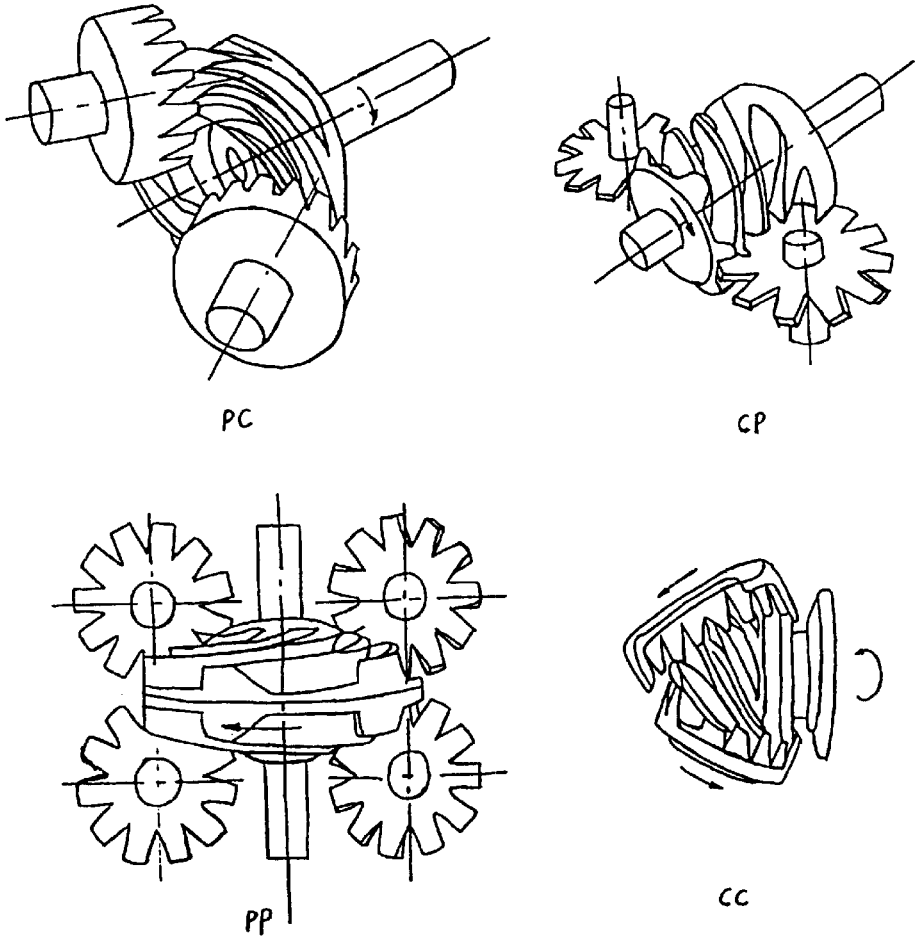
FIG. 2 is a perspective view showing 4 types of conventional single screw compressors.
Figure 3:
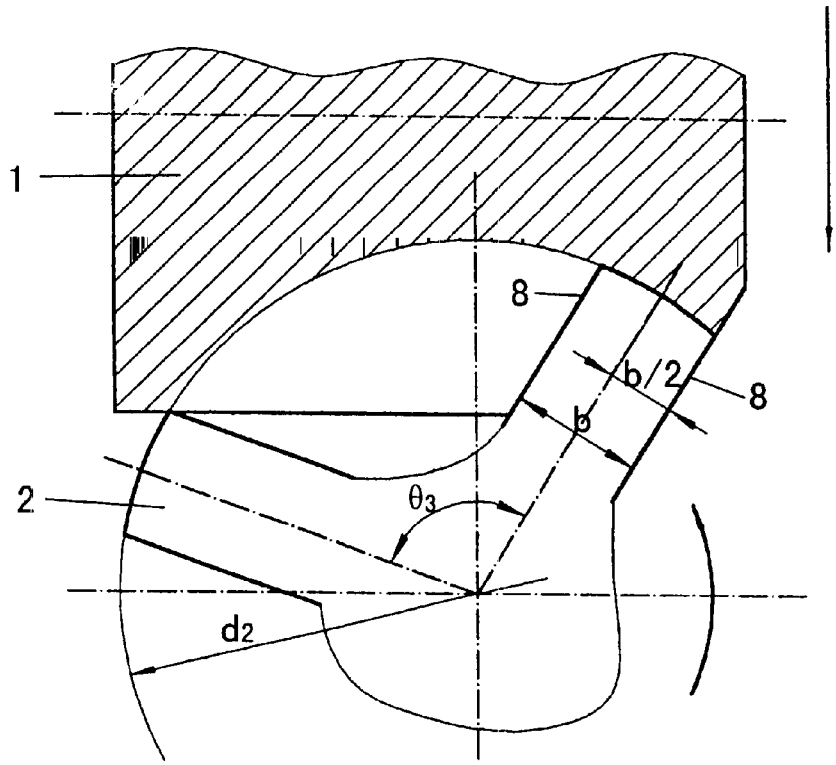
FIG. 3 Prior Art
FIG. 3 is a partially cutaway section view showing the engagement of the screw with a pinion in the compressor of FIG. 1.
Figure 4:
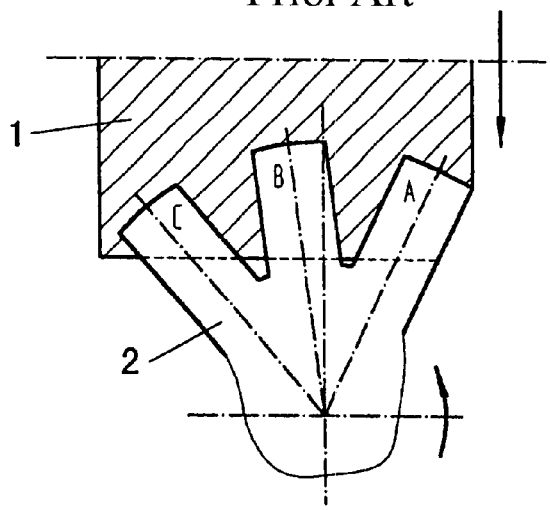
FIG. 4 is a view showing the compression of the gas in the compressor of FIG. 1.
Figure 5:
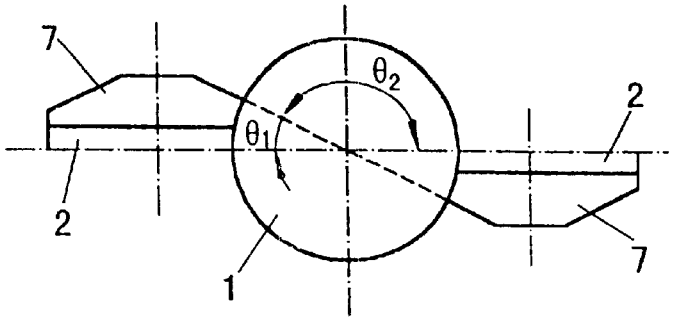
FIG. 5 is a view showing the engagement of the screw 1 with two pinions 2.
Figure 6:
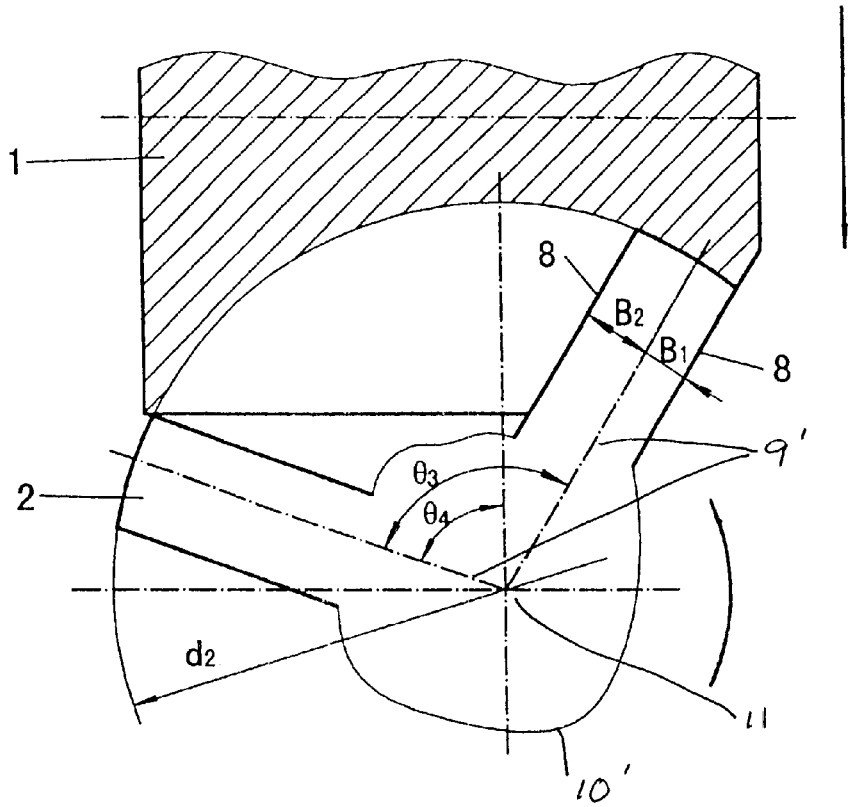
FIG. 6 is a view showing the engagement of the screw 1 with two pinions 2.

FIG. 6 is a view showing the engagement of the screw with one pinion of the single screw compressor according to the present invention. As shown in FIG. 6, the width of the left part of the pinion tooth is not the same as that of the right part of the pinion tooth. When each of the pinion teeth is separated into two parts B1 and B2 by an imaginary dividing line 9' parallel to the right generating line through the rotating center 11' of the pinion 10'. The width of the left part B2 is larger than that of the right part B1. This is referred to as an unequal-width pinion tooth to distinguish it from the equal-width pinion tooth in the conventional art.

Figure 7:
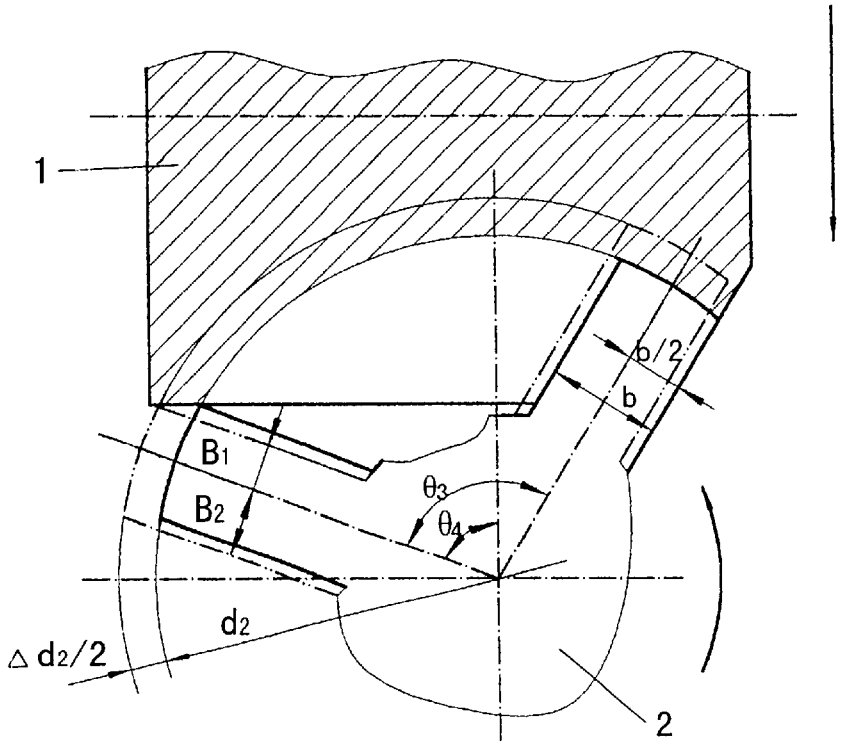
FIG. 7 is a view comparing the shape of the unequal-width pinion teeth according to the present invention with that of the conventional equal-width pinion teeth.

Referring to FIG. 7, the shape of the conventional pinion teeth and the unequal-width pinion teeth are respectively represented in solid lines and double-chain lines while the other parameters of the two kinds of teeth are the same. The diameter of an unequal-width pinion tooth may be $\Delta d_2$ longer than that of a conventional pinion tooth, $d_2$, when the two largest work rotation angles of the two kinds of teeth are the same. When the outer profile of the screw is cylindrical, the increment $\Delta d_2$ can be derived from the formula as follows.

$$\Delta d_2 = 2\sqrt{\left[(b/2 - B_1)tg\theta_4 + \sqrt{(d_2/2)^2 - (b/2)^2}\right]^2 + B_1^2} - d_2$$

When the shape of the outer profile of the screw is changed, the diameter of the pinion may also be increased by adopting unequal-width teeth. The formula for calculating the increment $\Delta d_2$ should be changed correspondingly or the increment $\Delta d_2$ may be obtained by the digraph method.

Compared with the conventional art, the increase with the diameter of the pinion by application of the new technique of unequal-width teeth has the following advantages:

1. An increase in discharge volume and raising Energy Efficiency Ratio of the compressor. The discharge volume of a 30kw single screw compressor is increased by 20% and its Energy Efficiency Ratio is increased by 5% with the improved single screw compressor of the present invention.

2. A decrease in the bulk and weight of the Compressor. The increase of the diameter of the pinion increases the discharge volume of the gas, thus the diameter of the screw can be decreased if the discharge volume is required to be kept constant. In this; manner, the bulk and weight of the compressor can be decreased simultaneously with the increase in the Energy Efficiency Ratio.

3. Creating favorable conditions for the development of a low discharge volume single screw compressor. Conventionally, the lower the gas discharge volume of a single screw compressor, the worse the Energy Consumption Index is expected to be. This results in inferior energy conservation compared with other types of compressors. The lowest motor power of a conventional single screw compressor is now 30 kw. With the unequal-width teeth in accordance with the present invention, it is possible to provide a single screw compressor with a motor power of 15 kw with the increase in Energy Efficiency Ratio achieved by the present invention.

4. An improvement in the rigidity of the pinion stand and increase in the durability of the pinion. When the diameter of the pinion is fixed, the angle $\theta_3$ of the pinion with unequal-width teeth is smaller and the angle $\theta_1$ of the same is bigger, so that the durability of the pinion is increased with the increase of the thickness and rigidity of the stand. When the diameter of the pinion is increased, the durability of the pinion is improved as a result of the increase of the engagement area of the flanks of the pinion teeth. In most cases, both the diameter of the pinion and the rigidity of the pinion stand can be increased.

The only difference between the unequal-width teeth and the conventional equal-width teeth exists in the difference between of the width of the left and right half of the tooth created by a change in the position of the generating line, thus the engagement surface (flank) of the pinion remains as a conjugated curved surface of the tooth flank of the screw. Therefore, the processing of the pinion's flanks and screw's grooves can be achieved by a corresponding shift of the cutting tools.

Figure 16:
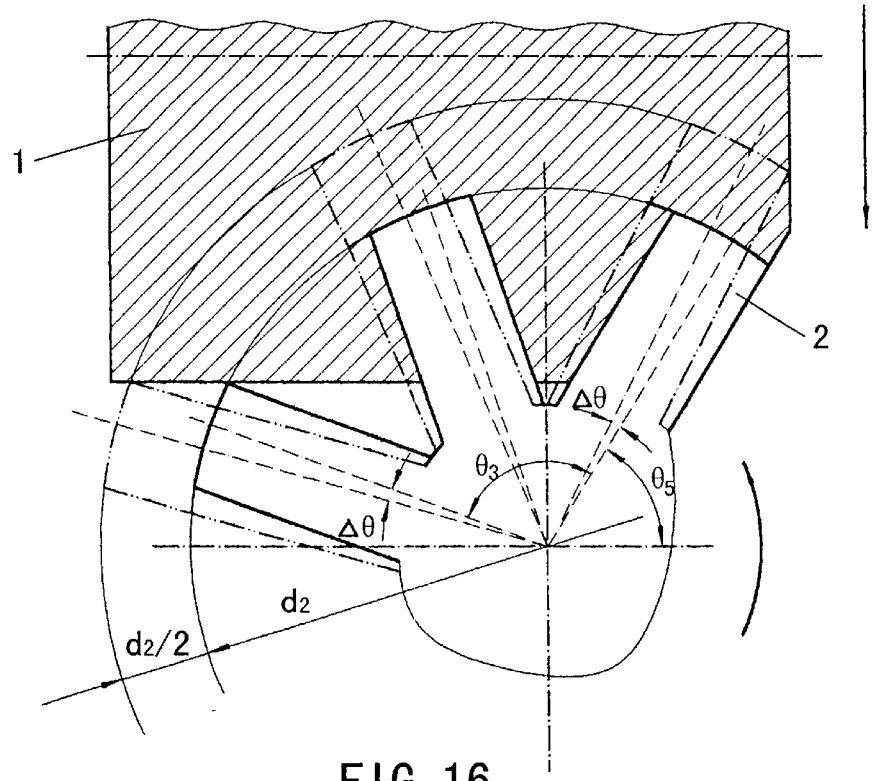
FIG. 16 is a view comparing the closing angle of the compressor of FIGS. 8–14 with that of the conventional compressor.

Referring to FIG. 16, the closing angle $\theta_5$ is formed upon the closed engagement of a pinion tooth with a groove of the screw. The closing angle $\theta_5$ of a conventional compressor is around 60°. When $\theta_3$ is kept fixed, the diameter of the pinion is increased by $\Delta d_2'$ if $\theta_5$ is enlarged by $\Delta\theta$. In this manner, the objectives of conserving energy and increasing gas discharge volume can be achieved with the adoption of the unequal-width teeth of the present invention. The preferred range of the closing angle $\theta_5+\Delta\theta$) of the compressor according to the present invention is from 60° to 66°.

Figure 8:
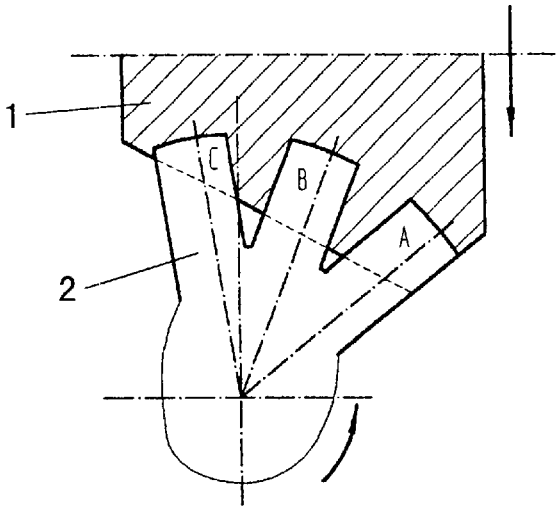
FIG. 8 is a view showing the operation of a preferred embodiment according to the present invention.
Figure 9:
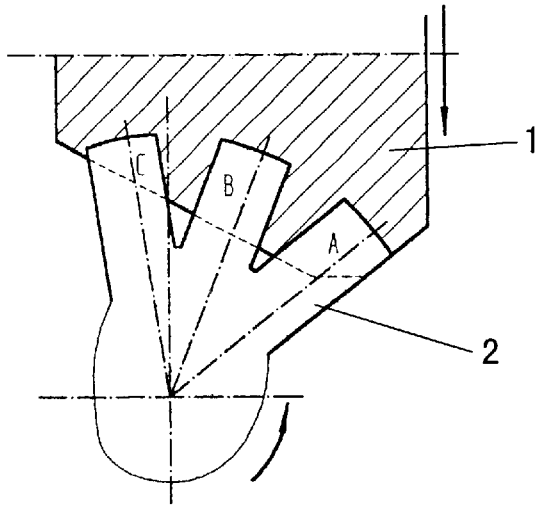
FIG. 9 is a view showing the operation of a preferred embodiment according to the present invention.
Figure 10:
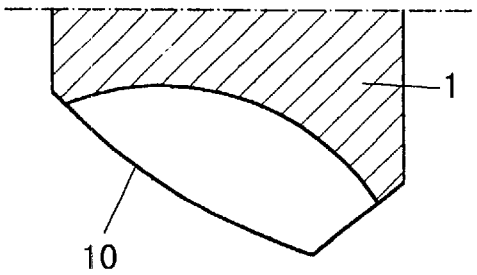
FIG. 10 is a view showing the outer profile of the high pressure section of the screw of an embodiment according to the present invention.
Figure 11:
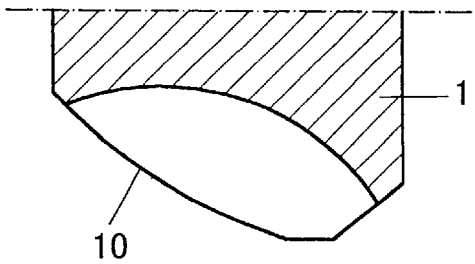
FIG. 11 is a view showing the outer profile of the high pressure section of the screw of an embodiment according to the present invention.
Figure 12:
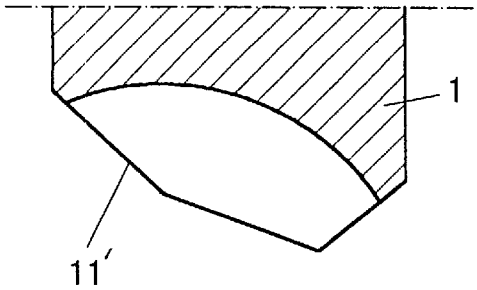
FIG. 12 is a view showing the outer profile of the high pressure section of the screw of an embodiment according to the present invention.
Figure 13:
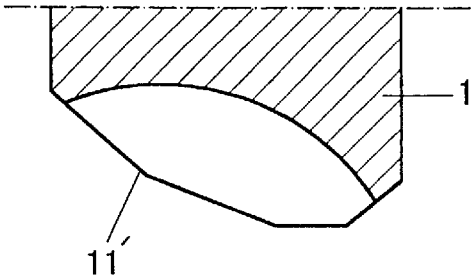
FIG. 13 is a view showing the outer profile of the high pressure section of the screw of an embodiment according to the present invention.

As mentioned above, the compression and discharge of the gas in the high pressure section of a conventional CP type single screw compressor are accomplished at a position further away from the axis of the screw, and results in higher energy consumption . To overcome such a drawback, the diameter of the high pressure end of the screw of the compressor according to the present invention is decreased with an objective to conserve energy by making the compression and discharge of the gas in the high pressure section at a position closer to the axis of the screw. The detailed process is described with reference with FIGS. 8–13. The outer profile of the high pressure section and that of the low pressure section of the screw illustrated in FIG. 8 are made conal. This is not good for energy conservation. In accordance with the present invention as shown in FIG. 9, the outer profile of the high pressure section of the screw is made conal and the low pressure section is made cylindrical. As modified, the energy consumption is increased because the compression of the gas of the low pressure section is being accomplished at the larger end of the screw further away from the axis of the screw. However, at the same time the energy consumption is decreased as a result of the compression of the gas of the high pressure section being accomplished at the smaller end of the screw closer to the axis of the screw. The result is a decrease in overall energy consumption because the pressure at the high pressure section is much higher than that at the low pressure section, and the reduction of the energy consumption is much more than the incremental increase in energy consumption.

It is known that the larger the compression ratio, the more the energy consumption. Specifically, in a popular single screw compressor with a discharge pressure of 0.7 Mpa, if the unequal-width teeth of the present invention are adopted, the dynamic calculation shows that the energy conservation could be increased by 8% as compared to that of a conventional single screw compressor when the half cone angle is 20°. The energy conservation can be increased approximately 10% when the half cone angle is 25°. However, the amount of the energy conserved cannot be increased correspondingly if the half cone angle is too large. When the angle is too large, both the axial force of the screw and the bulk of the compressor will be greatly increased. Therefore, the half cone angle is preferable not over 45°. This is much less than that of the conventional PP type single screw compressor where the cone angle is 90°. With the decrease in cone angle, there is no need to use a pair of screws in one compressor as with the conventional PP type compressor because the axial force is lower.

Figure 14:
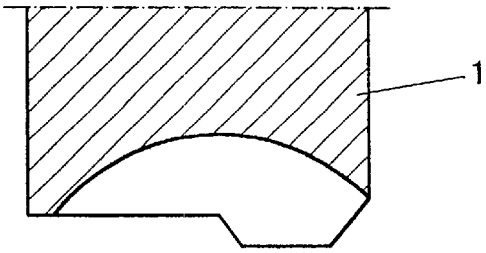
FIG. 14 is a view showing the outer profile of the high pressure section of the screw of another preferred embodiment according to the present invention.

Referring to FIG. 14, the high pressure section of the screw may also be in a shape of cylinder with a smaller diameter in its outer profile.

The section between the two cylindrical sections is in the shape of a cone in its outer profile with a larger half cone angle.

Figure 15:
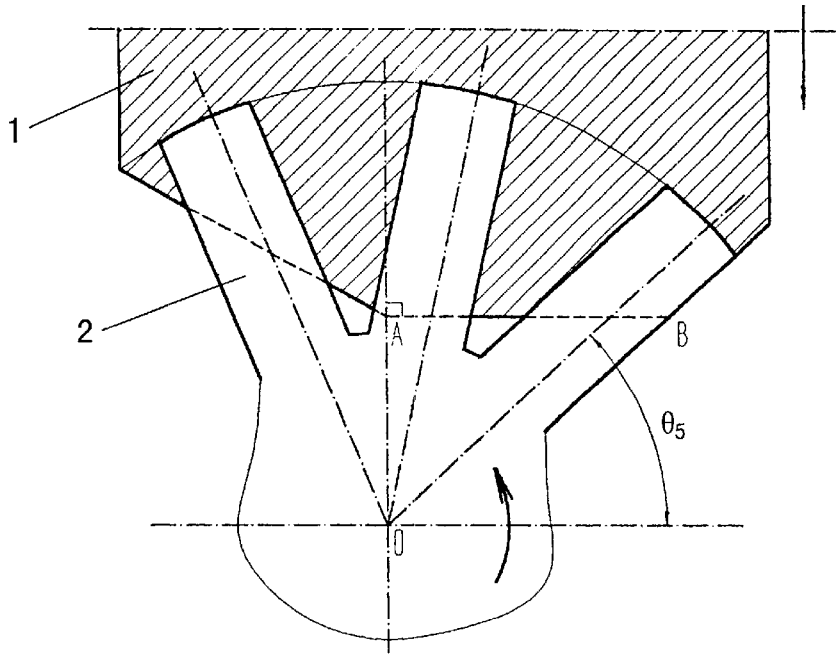
FIG. 15 is a view showing the relation of the connecting line AO to the generating line of the low pressure section of the compressor of FIGS. 8–14.

Referring to FIG. 15, the connecting line of the crossover point A of the generating lines of the high and low pressure sections with the rotating center O of the pinion is perpendicular to the generating line AB of the low pressure section. The length of segment AB is related to the durability of the pinion; that is, the longer the length of the segment AB, the better the durability of the pinion. Therefore, the angle $\theta_5$ should be somewhat decreased to increase the length of the segment AB, and also to have more pinion teeth engaging with the screw at the same time when the diameter of the high pressure section of the screw has been decreased.

With the present invention, neither the processing technology nor the processing apparatus of the grooves of the screw will be affected because the shape of the groove is maintained while the outer profile of the screw is changed. As a result, the main advantages of the single screw compressor are maintained with the vastly decrease in energy consumption by the single screw compressor of the present invention.

The generating line of the cone of the screw may be a straight line 9 (referring to FIG. 8 and FIG. 9), or a curved line 10 (referring to FIG. 10 and FIG. 11 ) or a polygonal line 11 (referring to FIG. 12 and FIG. 13) or any optional combination of thereof.

The embodiments described above are intended to be representative and not limiting. Additional embodiments of the invention are within the claims. As will be understood by those skilled in the art, many changes in the apparatus described above may be made by the skilled practitioner without departing from the spirit and scope of the invention, which should be limited only as set forward in the claims which follow.

What is claimed is:

1. A single screw compressor comprising two pinions with teeth wherein the teeth of said pinions are modified to be unequal in width, with each pinion teeth being separable into two parts, a left part and a right part, by an imaginary dividing line parallel to the right of the line generated through the center of rotation of each pinion, the width of the left part being larger than that of the right part.

* * * * *